United States Patent [19]

Neyret

[11] Patent Number: 4,873,852

[45] Date of Patent: Oct. 17, 1989

[54] FORK FOR THE FIXATION OF A CYLINDER LOCK PLUG

[76] Inventor: Guy Neyret, 11, rue du Fort, 69340 Francheville, France

[21] Appl. No.: 264,361

[22] Filed: Oct. 31, 1988

[30] Foreign Application Priority Data

Nov. 6, 1987 [FR] France ..... 87 15752

[51] Int. Cl.[4] ..... E05B 09/08

[52] U.S. Cl. ..... 70/451; 70/370

[58] Field of Search ..... 70/451, 370, 449, 448; 248/27.3, 27.1

[56] References Cited

U.S. PATENT DOCUMENTS 2,443,362 6/1948 Tinnerman ..... 70/370
2,549,724 4/1951 Tinnerman .
2,629,248 2/1953 Burdick ..... 70/370
2,948,141 8/1960 Vahlstrom .
3,488,984 1/1970 Salonia ..... 70/451

FOREIGN PATENT DOCUMENTS 2360727 9/1978 France ..... 70/451

*Primary Examiner*—Robert L. Wolfe
*Attorney, Agent, or Firm*—Young & Thompson

[57] ABSTRACT

The invention relates to a fixation fork for a cylinder lock plug, adapted for being placed underneath the plug head and to maintain it flat against a fixation panel. The fork is fast with a second fork cooperating with the end of the plug which is opposite the plug head, the assembly being provided with wings bearing on the fixation panel. Application to automobile vehicle door locks.

10 Claims, 3 Drawing Sheets

FORK FOR THE FIXATION OF A CYLINDER LOCK PLUG

FIELD OF THE INVENTION

The invention relates to a fixation fork for a cylinder lock plug, particularly but not exclusively for automobile vehicle doors.

Usually, the fork, placed underneath the plug head, maintains the latter applied against a fixation panel, with interposition of a resilient seal.

A tool placed in the key channel of the plug allows oscillating it so that, by successive alternating movements, it is possible to cause the fork to crawl and to extract the plug, thereby providing access to the lock.

OBJECTS AND SUMMARY OF THE INVENTION

The present invention has as an object a new fixation fork prohibing imparting to the plug such successive oscillation movements.

To this effect, the fork according to the invention is characterized by the fact that it is made fast with a second fork cooperating with the end of the plug which is opposite the head, the assembly being provided with wings bearing on the fixation panel.

The part can be made either of a folded cut-out metal sheet or of a molded material.

The constitution of the fork as a piece provided with side wings and a second fork bearing on one end of the plug forms an extremely rigid assembly, any attempt to oscillate the plug producing a bracing action on the part and on the plug.

In one embodiment, the side wings are formed in the prolongation of the first fork. In an alternative embodiment, the side wings are formed at the ends of arms extending beyond the second fork.

According to another embodiment of the invention, the two forks are connected by a wall joining their heads.

According to a variant, the two forks are connected by side walls.

BRIEF DESCRIPTION OF DRAWINGS

The invention will be better understood from the following description, with reference to the accompanying drawings wherein.

DETAILED DESCRIPTION OF THE INVENTION

Figure 1:
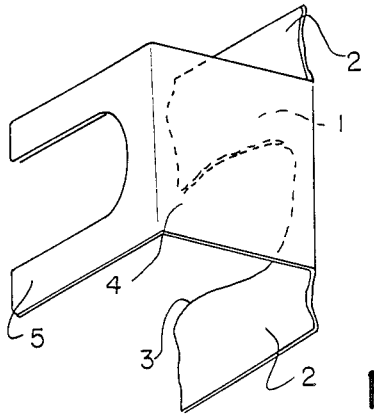
FIG. 1 is a perspective schematic view of a fork according to an embodiment of the invention.
Figure 2:
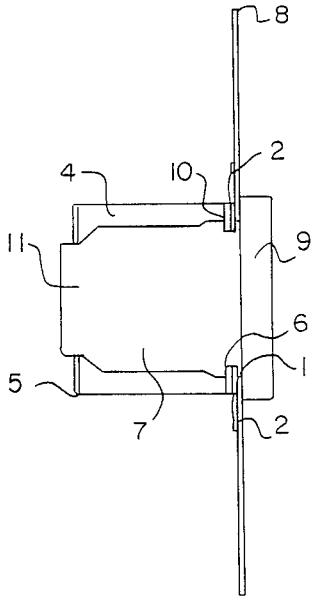
FIG. 2 is a schematic side elevation view of the fork of FIG. 1, mounted on a panel.

In the embodiments of FIGS. 1 and 2, the fork 1 is prolonged sideways by two wings 2 while its head, opposite slot 3, is prolonged by an orthogonal wall 4 integral with a second fork 5 parallel to fork 1 and extending in the same direction.

When mounted (FIG. 2), fork 1 is accommodated inside a peripheral slot 6 of plug 7, against the mounting panel 8 on which bears the head 9 of plug 7. A resilient seal 10 is also accommodated in slot 6. The wings 2 of fork 1 are longitudinally corrugated in such manner that fork 1 includes bearing shoes and exerts on plug 7 a force directed to the inside, so that the head 9 of plug 7 is compressed against the outer face of panel 8.

The second fork 5 straddles the end 11 of plug 7. The assembly formed by the two forks 1 and 5 bearing on plug 7 and connected to each other via wall 4 is very rigid and braced against panel 8, so that it is practically impossible to oscillate plug 7.

Figure 3:
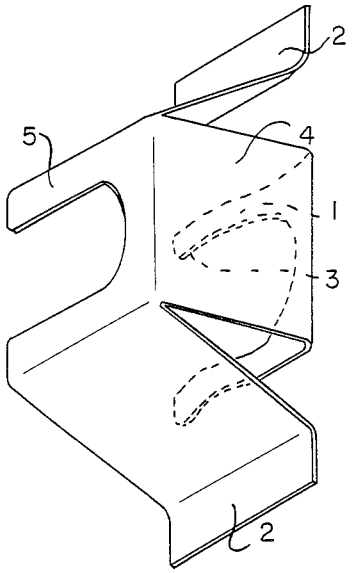
FIGS. 3, 5 and 6 are schematic perspective views of alternative embodiments of the fork according to the invention.
Figure 4:
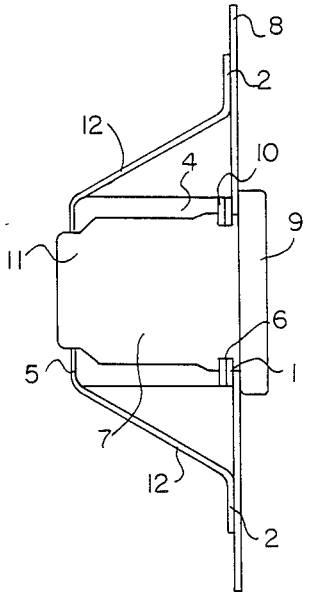
FIG. 4 is similar to FIG. 2, for the fork of FIG. 3.

In the embodiments of FIGS. 3 and 4 wherein the same reference numerals designate the same elements as in FIGS. 1 and 2, the bearing wings 2 are planar and each connected to the second fork 5 by a slanting wall 12. It is the articulation of walls 12 on fork 5 which provides the bearing resilient force of wings 2 against the inner face of panel 8.

Figure 5:
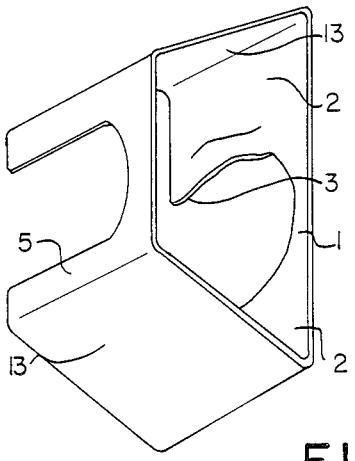
Figure 6:
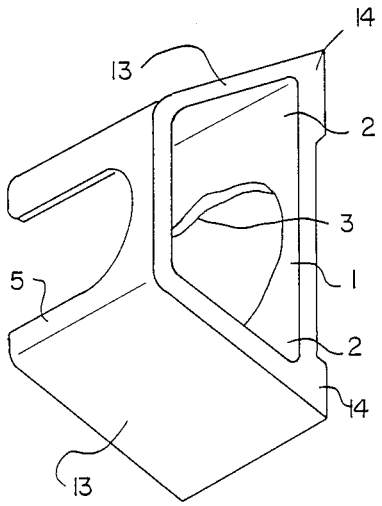

In the alternative embodiments of FIGS. 5 and 6, fork 5 is directly connected to the end of each of wings 2 via slanting walls 13, wings 2 being transversely corrugated. The assembly has a trapezoidal longitudinal cross-section.

The embodiments of FIGS. 1 and 5 relate to cut-out and bent metallic parts, which can be welded in the case of FIG. 5.

The embodiment of FIG. 6 relates to a closed part, molded from a synthetic material or from a metallic alloy, for example zinc or aluminum based. In such a case, one can provide the wings 2 with bearing shoes 14.

I claim:

1. A fixation fork for a cylinder lock plug, provided for being placed underneath the head of the plug to maintain it flat against a fixation panel, characterized by the fact that it is fast with a second fork cooperating with the end of the plug which is opposite the head, one of said forks being provided with wings bearing on the fixation panel.

2. A fork according to claim 1, characterized by the fact that said wings are formed in the prolongation of the first fork.

3. A fork according to claim 1, characterized by the fact that said wings are formed at the ends of arms extending beyond the second fork.

4. A fork according to claim 2, characterized by the fact that said two forks are connected via a wall joining their heads.

5. A fork according to claim 1, characterized by the fact that said two forks are connected by side walls.

6. A fork according to claim 5, characterized by the fact that said side walls are connected to the free ends of said wings.

7. A fork according to claim 1, characterized by the fact that said wings are transversely or longitudinally corrugated.

8. A fork according to claim 1, characterized by the fact that said fork is constituted of a cut-out and bent metallic part, possibly welded.

9. A fork according to claim 1, characterized by the fact that said fork is constituted of a part molded from a synthetic material or from a metal.

10. A fork according to claim 1, characterized by the fact that said wings include bearing shoes.

* * * * *